United States Patent [19]

Dyer et al.

[11] Patent Number: 4,766,462

[45] Date of Patent: Aug. 23, 1988

[54] LIQUID CARRIER RECOVERY SYSTEM

[75] Inventors: Dexter A. Dyer, Williamson; William C. Howe, Walworth; Thomas F. Szlucha, Fairport, all of N.Y.

[73] Assignee: Xerox Corporation, Stamford, Conn.

[21] Appl. No.: 887,766

[22] Filed: Jul. 21, 1986

[51] Int. Cl.[4] ..... G03G 21/00; G03G 15/20

[52] U.S. Cl. ..... 355/10; 355/3 FU; 34/73

[58] Field of Search ..... 355/10, 3 FU, 30; 34/73, 75; 55/269

[56] References Cited

U.S. PATENT DOCUMENTS

| | | | |
|---|---|---|---|
| 3,130,079 | 4/1964 | Von Meister | 118/661 |
| 3,854,224 | 12/1974 | Yamaji et al. | 355/10 X |
| 3,861,863 | 1/1975 | Kudsi | 432/60 |
| 4,297,713 | 10/1981 | Ichikawa et al. | 355/3 R X |
| 4,462,675 | 7/1984 | Moraw et al. | 355/3 R |
| 4,506,456 | 3/1985 | Lehtinen | 34/12 |
| 4,571,056 | 2/1986 | Tani et al. | 355/3 FU |
| 4,687,319 | 8/1987 | Mishra | 355/10 |

FOREIGN PATENT DOCUMENTS

| | | | |
|---|---|---|---|
| 2459178 | 6/1975 | Fed. Rep. of Germany . | |
| 55-50289 | 4/1980 | Japan | 355/3 FU |
| 1436571 | 5/1976 | United Kingdom . | |
| 2097335A | 11/1982 | United Kingdom . | |

*Primary Examiner*—Arthur T. Grimley
*Assistant Examiner*—J. Pendegrass
*Attorney, Agent, or Firm*—H. Fleischer; J. E. Beck; R. Zibelli

[57] ABSTRACT

A reproducing machine in which an electrostatic latent image recorded on a photoconductive member is developed with a liquid developer material comprising at least a liquid carrier having pigmented particles dispersed therein. The developed image is transferred from the photoconductive member to a sheet of support material. The sheet of support material, with the developed image thereon, passes through a housing. In the housing, heat and pressure are applied to the sheet of support material to vaporize the liquid carrier and to fuse the pigmented particles to the sheet of support material in image configuration. An interior surface of the housing is cooled to liquefy the vaporized liquid carrier thereon.

12 Claims, 2 Drawing Sheets

LIQUID CARRIER RECOVERY SYSTEM

This invention relates generally to an electrophotographic printing machine, and more particularly concerns recovering liquid carrier vaporized during the fusing of the liquid image to the copy sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration on the photoconductive member. Thereafter, the developed image is transferred to the copy sheet. Invariably, some of the liquid carrier is transferred along with the pigmented particles to the copy sheet. After transfer, heat is applied to the copy sheet to permanently fuse the pigmented particles to the copy sheet and vaporize the residual liquid carrier adhering thereto. Current fusing systems require large amounts of heat and high pressure to fuse the pigmented particles and maintain the liquid carrier vapor levels at a safe operating condition, i.e. less than 25% of the lower explosion limit.

Numerous techniques have been developed for heating the developed image on the copy sheet to permanently fuse the pigmented particles thereto. Among these are oven fusing, hot air fusing, flash fusing and roll fusing. It has been found that roll fusing requires significantly lower energy requirements than radiant or oven fusing. Moreover, there is a reduced production of water vapor due to reducing the bulk heating of the copy sheet during the fusing of the pigmented particles thereto. In order to minimize environmental hazards and insure that the electrophotographic printing machine may be employed in an office environment, the vaporized liquid carrier cannot be vented to the atmosphere. Environmentally hazardous conditions arise when the vaporized liquid carrier is discharged to the atmosphere. Hence, it is necessary to recover the vaporized liquid carrier prior to the discharge of the liquid carrier saturated air to the atmosphere. Hereinbefore, various techniques have been devised for reclaiming vaporized liquid materials. The following disclosures appear to be relevant:

U.S. Pat. No. 4,462,675, Patentee: Moraw et al., Issued: July 31, 1984.

U.S. Pat. No. 4,506,456, Patentee: Lehtinen, Issued: Mar. 26, 1985.

U.S. Pat. No. 4,571,056, Patentee: Tani et al., Issued: Feb. 18, 1986.

Great Britain Pat. No. 1,436,571, Published: May 19, 1976, Patentee: Canon.

Great Britain Application No. 2,097,335A, Published: Nov. 3, 1982, Patentee: Mair.

The relevant portions of the foregoing disclosures may be briefly summarized as follows:

Moraw et al. discloses a process for thermally fixing a liquid developed image on a sheet by applying heat and vaporizing the developing liquid. The evaporated liquid is sucked off, condensed, separated and collected in a separate chamber. A heater plate is employed for applying heat. The heated plates may be curved to obtain an improved pressure or heated rollers may be used.

Lehtinen describes a method for drying a porous web in which the wet web is passed onto a drying felt pad. The web and felt are subjected to high temperatures and pressures with a flat plate, then quickly decompressed causing explosive evaporation of the solvent in the web. Felt pads are employed to absorb the vapor.

Tani et al. describes a fixing device including a heated roller and a pressure roller. The rollers are maintained in pressing contact with each other and a toner bearing image sheet passes therebetween. The rollers are located in a chamber with a blower being provided to remove air from the chamber.

Canon describes an apparatus for drying copying material and fixing an image thereon. The solvent is vaporized by applying heat to the liquid image. A constant air flow is maintained to keep the temperature of the vapor sufficiently low to prevent the occurrence of combustion. A solvent recovery system may be positioned to receive the lost air containing the vaporized material therein.

Mair describes a solvent recovery system employing cooling coils located in the walls of a fusing chamber in a xerographic system employing a hot solvent vapor to fuse toner particles.

In accordance with one aspect of the present invention, there is provided a reproducing machine of the type having a latent image recorded on a member. Means are provided for developing the latent image recorded on the member with a liquid developer material comprising at least a liquid carrier having pigmented particles dispersed therein. Means transfer the developed image from the member to a sheet of support material. A housing is provided having sheet inlet and sheet outlet passageways therein. Means, disposed interiorly of the housing apply heat and pressure to the sheet of support material having the developed image thereon to vaporize liquid carrier thereon and to fuse the pigmented particles to the sheet of support material in image configuration. Means cool the housing to liquefy the vaporized liquid carrier on an interior surface of the housing.

Pursuant to another aspect of the features of the present invention, there is provided an electrophotographic printing machine having a photoconductive member and means for recording an electrostatic latent image on the photoconductive member. Means develop the latent image recorded on the photoconductive member with a liquid developer material comprising at least liquid carrier having pigmented particles dispersed therein. Means transfer the developed image from the photoconductive member to a sheet of support material. A housing is provided having sheet inlet and sheet outlet passageways thereto. Means, disposed interiorly of the housing, apply heat and pressure to the sheet of support material having the developed image thereon to vaporize liquid carrier thereon and to fuse the pigmented particles to the sheet of support material in image configuration. Means are provided for cooling the housing to liquefy the vaporized liquid carrier on an interior surface of the housing.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
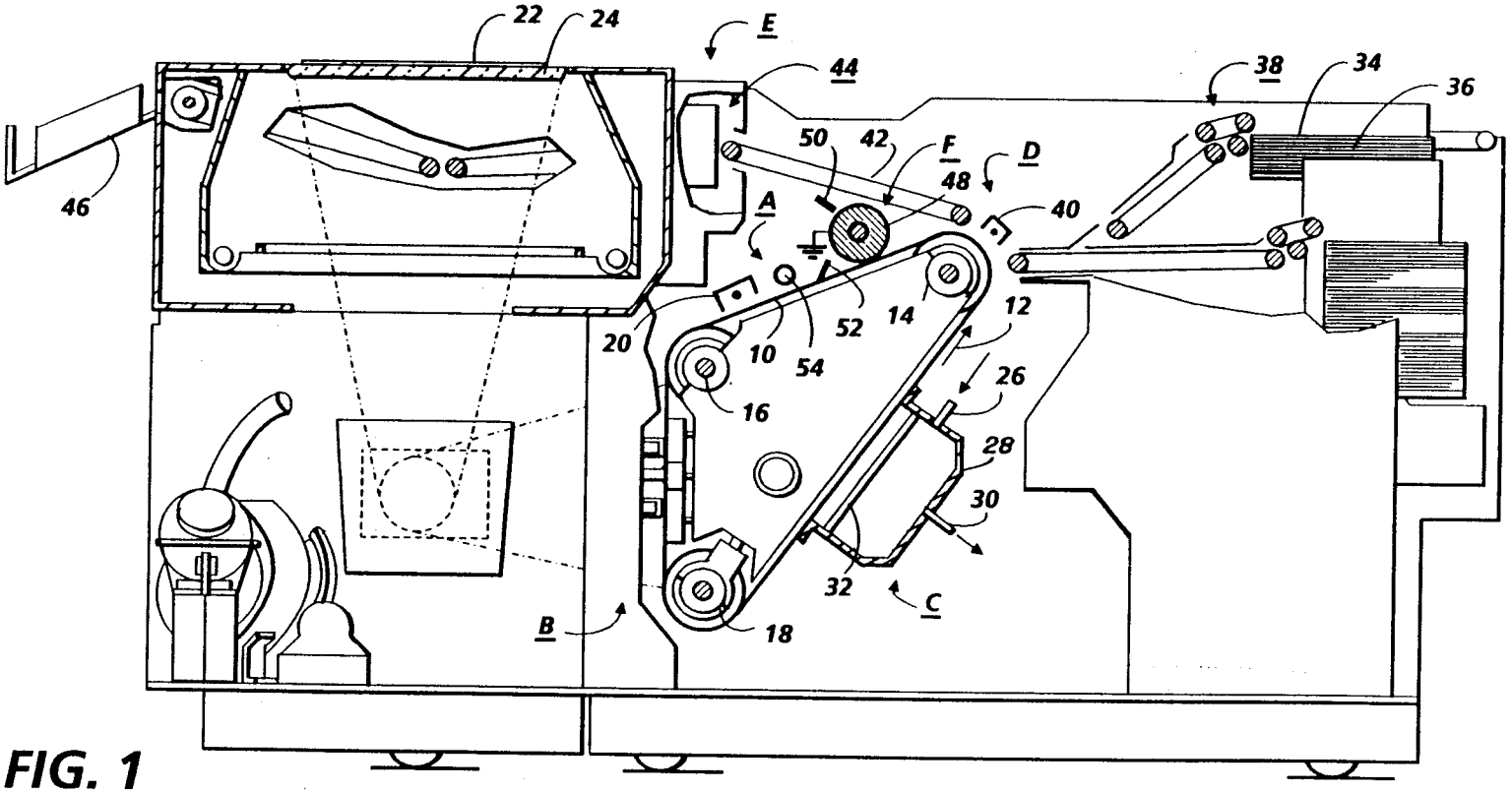
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C. At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Fusing station E includes a fuser assembly and a solvent recovery system indicated generally by the reference 44. The fuser assembly vaporizes the liquid carrier from the copy sheet and permanently fuses the toner particles in image configuration thereto. The solvent recovery system reclaims the vaporized liquid carrier for subsequent reuse. The detailed structure of fuser assembly and solvent recovery system 44 will be described hereinafter with reference to FIGS. 2 and 3. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles dispersed therein A suitable insulating liquid carrier may be made from aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Figure 2:
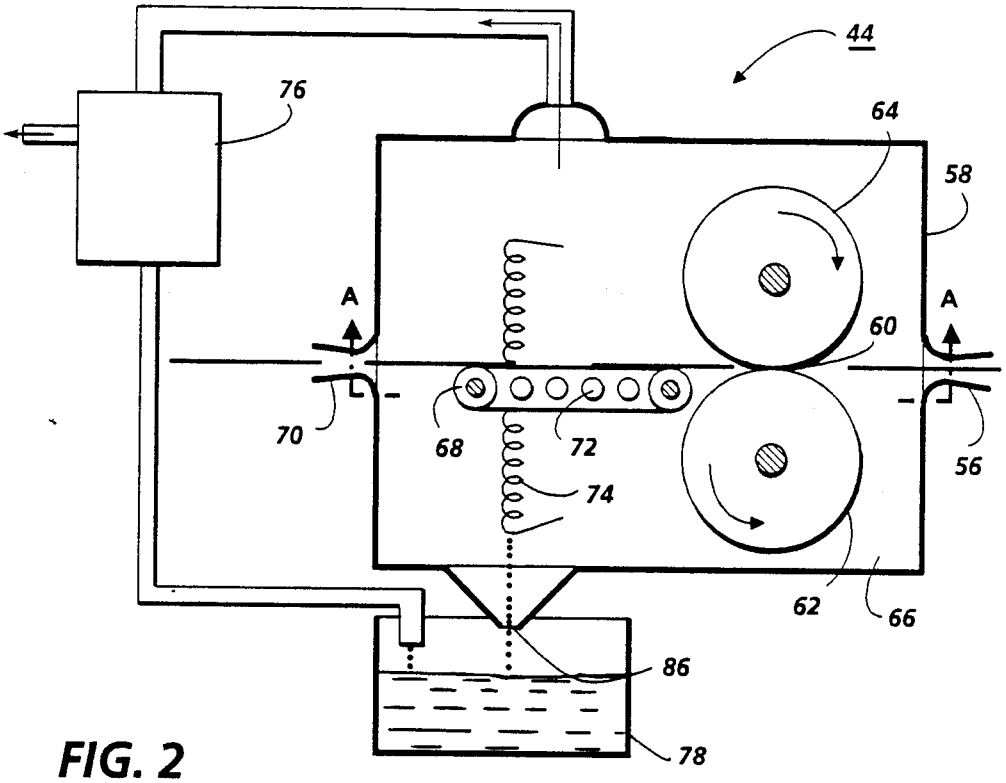
FIG. 2 is an elevational view depicting the fusing apparatus and solvent recovery system used in the FIG. 1 printing machine.

Referring now to FIG. 2, there is shown fuser assembly and solvent recovery system 44 in greater detail. As depicted thereat, a copy sheet advances into entrance passageway 56 of housing 58. The copy sheet then advances into nip 60 defined by fuser roller 62 and back-up pressure roller 64. Rollers 62 and 64 are resiliently urged into engagement with one another to define nip 60. Preferably, back-up roller 64 includes a rigid internal core which may be steel, over which is a sleeve-like cover of flexible material having non-stick properties such as Teflon, is mounted. Fuser roller 62 similarly has a rigid internal core which may be steel, having a relatively thick sleeve-like coverning thereover. The fuser roller sleeve is comprised of a flexible material, such as Silicone rubber. To heat fuser roller 62, a lamp is disposed within the fuser roller core. The core has a suitable opening for receipt of the lamp. In this arrangement, heat energy from the lamp permeates through the metal core and the outer sleeve to heat the surface of fuser roller 62 to the requisite temperature required to fuse the pigmented particles on the copy sheet. The liquid carrier material on the copy sheet is vaporized. Preferably, fuser roller 62 and pressure roller 64 apply between 50 to 150 pounds per square inch of pressure on the copy sheet with the copy sheet being heated from about 210° F. to about 280° F. (100° C. to about 140° C.). At these temperatures and pressures, the toner particles are fused to the copy sheet and the liquid carrier vaporized. As shown in FIG. 2, fuser roller 62 and pressure roller 64 are disposed in chamber 66 of housing 58. A conveyor 68 advances the copy sheet from nip 60 to the exit passageway 70 for subsequent advancement to catch tray 46 (FIG. 1). Conveyor 68 has heating elements 72 disposed therein to further heat the copy sheet, if necessary, to insure any residual liquid carrier thereon is vaporized. The solvent recovery system includes a condenser system having cooling coils 74 mounted on at least the exterior surface of one wall of housing 58. A compressor system 76 maintains chamber 66 of housing 58 at a negative pressure with respect to atmospheric pressure. A fan 80 (FIG. 3) directs a flow of air across the copy sheet after it exits nip 60 to remove the vaporized liquid carrier from the vicinity thereof. The vaporized liquid carrier condenses on the back wall being cooled by cooling coils 74. The liquefied liquid carrier vapors condensed on the back wall of housing 58 drip, under the influence of gravity, through opening 86 in housing 58 to a collection container 78. In addition, any liquefied liquid carrier formed in compressor 76 is also collected in container 78. The temperature of chamber 66 is maintained at about 100° F. (38° C.). Thus, air flow across the copy sheet path moves the super-saturated air from the nip exit area and directs it to the back wall which is maintained at a lower temperature than the chamber. This wall forms a surface upon which the vaporized liquid carrier particles can condense and run down into container 78. Sufficient particle collision with the back wall maintains the vapor level of the chamber air below saturation and prevents collection of solvent on other surfaces.

Figure 3:
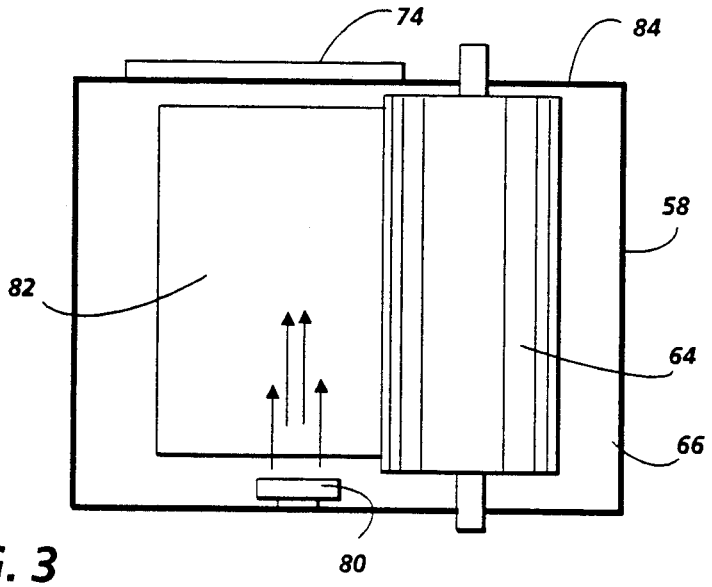
FIG. 3 is a sectional view taken in the direction of the arrows A—A of FIG. 2.

Turning now to FIG. 3, there is shown a partial sectional view taken in the direction of arrows A—A of FIG. 2. As shown thereat, fan 80 directs the flow of air across the copy sheet 82 exiting from the nip between fuser roller 62 and pressure roller 64. This flow of air is directed toward back wall 84 of housing 58. Wall 84 has cooling coils 74 mounted on the exterior surface thereof. In lieu of cooling coils, one skilled in the art will appreciate that a thermoelectric cooling device, such a Peltier cooler, may be employed and mounted on the exterior surface of wall 84 to provide cooling therefor. The walls of housing 58 are made from a suitable metal material. As the air flows across the path of the copy sheet, the super-saturated air from the nip exit area is removed therefrom and directed to wall 84 which is maintained at a lower temperature than chamber 66 of housing 58. Preferably, wall 84 is maintained at a temperature of about 35° F. The vaporized liquid carrier contacts wall 84 and condenses thereon. The liquefied liquid carrier vapor runs down the surface of wall 84 through opening 86 (FIG. 2) of housing 58 to container 78 for collection thereat. In this way, the air saturation point with respect to the chamber temperature is maintained at or below 25% of the lower explosion limit with the majority of solvent recovery being confined to one location with no moving parts. Furthermore, the energy requirements of the entire system are significantly reduced when compared to a heat exchanger and compressor based solvent recovery system.

In recapitulation, it is clear that the fusing apparatus and solvent recovery system of the present invention dries the copy sheet and permanently fuses the pigmented particles thereto in image configuration while collecting the vaporized liquid carrier on an interior surface of a cooled wall of the chamber housing. The liquefied vaporized liquid carrier is collected in a container and may be recycled to the development tray of the development system for subsequent reuse in the printing machine.

It is, therefore, evident that there has been provided in accordance with the present invention, a fusing apparatus and solvent recovery system that fully satisfies the aims and advantages heretofore mentioned. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed imaged from the member to a sheet of support material;

a housing having sheet inlet and sheet outlet passageways therein;

means, disposed interiorly of said housing, for applying heat and pressure to the sheet of support material having the developed image thereon to vaporize liquid carrier thereon and to fuse the pigmented particles to the sheet of support material in image configuration thereon;

means for cooling said housing to liquefy the vaporized liquid carrier on an interior surface of said housing; and means, mounted on a wall of said housing, for directing a flow of air across the path of the sheet of support material moving from the sheet inlet passageway to the sheet outlet passageway of said housing to move the vaporized liquid carrier from the region of said applying means to the interior surface said housing being cooled by said cooling means.

2. A reproducing machine according to claim 1, wherein said applying means includes:

a pressure roll; and a heated roll cooperating with said pressure roll to form a nip through which the sheet of support material having the developed image thereon passes so as to vaporize liquid carrier from the sheet of support material and to heat the pigmented particles to fuse the pigmented particles to the sheet of support material in image configuration.

3. A reproducing machine according to claim 2, further including means, associated with said housing, for collecting the liquefied liquid carrier.

4. A reproducing machine according to claim 3, wherein said cooling means includes a condenser system having cooling coils mounted on the exterior surface of one of the walls of said housing.

5. A reproducing machine according to claim 3, wherein said cooling means includes thermoelectric cooling means mounted on the exterior surface of one of the walls of said housing.

6. A reproducing machine according to claim 5, wherein said thermoelectric cooling means includes a Peltier cooling device.

7. An electrophotographic printing machine, including:

a photoconductive member;

means for recording an electrostatic latent image on said photoconductive member;

means for developing the latent image recorded on said photoconductive member with a liquid developer material comprising at least a liquid carrier having pigmented particles dispersed therein;

means for transferring the developed imaged from said photoconductive member to a sheet of support material;

a housing having sheet inlet and sheet outlet passageways therein;

means, disposed interiorly of said housing, for applying heat and pressure to the sheet of support material having the developed image thereon to vaporize liquid carrier thereon and to fuse the pigmented particles to the sheet of support material in image configuration thereon;

means for cooling said housing to liquefy the vaporized liquid carrier on an interior surface of said housing; and means, mounted on a wall of said housing, for directing a flow of air across the path of the sheet of support material moving from the sheet inlet passageway to the sheet outlet passageway of said housing to move the vaporized liquid carrier from the region of said applying means to the interior surface of said housing being cooled by said cooling means.

8. A printing machine according to claim 7, wherein said applying means includes:

a pressure roll; and a heated roll cooperating with said pressure roll to form a nip through which the sheet of support material having the developed image thereon passes so as to vaporize liquid carrier from the sheet of support material and to heat the pigmented particles to fuse the pigmented particles to the sheet of support material in image configuration.

9. A printing machine according to claim 8, further including means, associated with said housing, for collecting the liquefied liquid carrier.

10. A printing machine according to claim 9, where said cooling means includes a condenser system having cooling coils mounted on the exterior surface of the walls of said housing.

11. A printing machine according to claim 9, wherein said cooling means includes thermoelectric cooling means mounted on the exterior walls of said housing.

12. A printing machine according to claim 11, wherein said thermoelectric cooling means includes a Peltier cooling device.

* * * * *